US005335976A

United States Patent [19]

Dummermuth

[11] Patent Number: 5,335,976

[45] Date of Patent: Aug. 9, 1994

[54] TREATMENT DISK OF APPARATUS FOR ROUGHENING OR TREATING SURFACES

[75] Inventor: Paul Dummermuth, Zunzgen, Switzerland

[73] Assignee: Pamag AG, Switzerland

[21] Appl. No.: 15,547

[22] Filed: Feb. 9, 1993

[30] Foreign Application Priority Data

Feb. 10, 1992 [CH] Switzerland ..... 393/92
Jun. 23, 1992 [CH] Switzerland ..... 1973/92

[51] Int. Cl.[5] ..... B28D 1/18; E01C 23/09

[52] U.S. Cl. ..... 299/39; 51/176; 125/5; 299/89

[58] Field of Search ..... 299/39, 85, 89; 51/176; 125/5

[56] References Cited

U.S. PATENT DOCUMENTS 1,964,746 7/1934 Sloan ..... 299/39

FOREIGN PATENT DOCUMENTS 576920 5/1933 Fed. Rep. of Germany .
9104144 4/1991 World Int. Prop. O. .

*Primary Examiner*—David J. Bagnell
*Attorney, Agent, or Firm*—Speckman, Pauley & Fejer

[57] ABSTRACT

A treatment disk for devices for roughening or treating surfaces of stone floors, wherein hammer-like treatment points are mounted on the treatment disk opposite each of respectively semicircular slideways of the treatment disk. This shape makes it possible for an operation of a treatment point to cause the treatment disk to make a circular movement in the slideway and not, as previously known, a jumping or chattering movement as in a compressed air jack. The treatment disk is preferably made in three parts, so that the cutout has an overall shape resembling a three-leaf clover and the treatment points are offset by approximately 20° with respect to the symmetry axes of the clover leaf. This shape has proven to be particularly effective.

19 Claims, 3 Drawing Sheets

TREATMENT DISK OF APPARATUS FOR ROUGHENING OR TREATING SURFACES

BACKGROUND OF THE INVENTION

1. Field of the Invention

This invention relates to a treatment disk with treatment points distributed about its circumference and with a central cutout for freely movable seating and stringing together on a rotor cage rod of a device for toughening or treating surfaces.

2. Description of Prior Art

U.S. Pat. No. 1,964,746 discloses a similar device of a species of machines for treating stones, cleaning floors or roughening floors. In this connection, approximately 50 to 100 individual disks on a rotor cage rod are employed, for example. The treatment disks act tangentially, because the surface treatment device must evenly treat a majority of flat, stationary surfaces. For this purpose, a large number of treatment disks are relatively closely strung together and are individually seated directly on a rotor cage rod. The rotor itself has a plurality of rotor cage rods positioned in a circle, so that as uniform as possible a surface, particularly of stone and concrete floors, is created when the treatment machine is advanced.

A special embodiment of a similar species for cutting grooves into walls is taught by German Letters Patent 576,920. As a matter of principle, the individual treatment disks in both cases are embodied as a milling cutter and have a plurality of chisel heads or treatment points about the circumference. Each one has a cutout of preferably polygonal shape and a plurality of eccentric seating areas in the center for seating the treatment disk. It is thus not only possible for the treatment disk to rotate freely with respect to the cutout, but also to jump constantly from one seating area to the other. One point to consider is that each treatment point receives the same number of chisel treatments which results in even wear, at least theoretically. A second point to consider is that the device taught by PCT Reference WO 91/04144 primarily results in the generation of a chattering movement, which hampers the rotating movement.

The experience of many years is of interest. Similar results are obtained with almost any reasonable shape, so that development up to now has been focused mainly on questions regarding the materials. Eccentricity is a result of the polygonal shape of the seating areas in the cutout, on the one hand, and of the oppositely located treatment point on the other. Chisel forces are generated by the rapid revolutions of the rotor cage. Since the treatment disk immediately jumps to another position, a strong backlash effect on the rotor and drive because of the impact is avoided.

SUMMARY OF THE INVENTION

It is one object of this invention to remedy the disadvantages of conventional treatment disks and in particular to increase the effect of surface roughening or surface cleaning under comparable conditions.

The above and other objects are achieved in accordance with this invention wherein a cutout has a plurality of semicircular slideways such that a hammer-like treatment point, eccentric in relation to the center of the cutout, but oppositely located, is associated with the cutout. In an unexpected manner it is possible from the start to obtain up to 50% more work output with this invention, particularly with noticeably smoother operation. The cooperation between the semicircular slideways required by this invention and the hammer-like treatment area constitute an important aspect of this invention. Thus, the conceived model no longer is the chisel acting in a rapid manner, but the pointed hammer seated at the end of the hammer portion, somewhat analogous to the results achieved with classic hammer mills for breaking stones.

Due to the semicircular seating arrangement, the treatment disk does not jump into the nearest slideway at the first contact with or impact on the surface to be worked, nor is a rotating chattering movement generated. The treatment disk applies maximum kinetic energy by way of the treatment point in a strongly guided circular movement and thus makes precise treatment possible. The treatment disk does not change the seating place after each strike or revolution. Since the treatment process is not steady, considered over a period of time, sufficient position changes result with respect to the slideway, so that all treatment areas wear evenly. The clear association of the slideway point with the treatment area is essential for the success of this invention.

This invention allows for particularly advantageous embodiments. In some uses it has been shown that, with a defined number of rotations per minute, the treatment disks rotate in a central position and thus have a greatly reduced treatment effect. For this reason, the treatment point is positioned offset in the rotational treatment direction with respect to the oppositely located slideway point. The offset is selected in relation to an axis through the center of the cutout and a semicircular slideway preferably with less than 30° of angle, such as an angle of 10° to 25°. An optimum value was found with a 20° offset. Preferably the distance of the actual center of rotation of the slideway to the center of the cutout is selected at a ratio of approximately 1:3 in comparison with the distance from the center and a treatment point.

A particularly good result is achieved if the treatment disk has an odd number of slideways, preferably three for each center of rotation, as well as three treatment points. When three slideways are selected they have an overall appearance of a three-leaf clover in which the treatment areas, also three in number, are offset by 120°.

In this way, the mounting part of the treatment disk having the least concentration of material is located exactly opposite the striking part having the greatest concentration of material, each of the slideways being located on the "light" side. It is furthermore very advantageous if the treatment points are positioned in a tooth-shaped, protruding hammer head.

The transition from one slideway to the next is preferably embodied as a convex curve oriented towards the center of the cutout, and as a reinforcement of the striking head. A jump which occurs too frequently from one slideway to the next is prevented, but rolling from time to time from one slideway to the next is achieved, which particularly contributes to noise reduction during operation.

The eccentric slideways encompass at least an angle of approximately 180° and lead towards an imaginary center via a rolling shoulder towards the adjacent slideway. The slideways preferably have a symmetrical form in relation to a respective imaginary axis between the center of the cutout and the center of rotation, wherein respectively one treatment area is preferably positioned on an axis of symmetry.

It is also possible to position the treatment point on a hammer-like thickening of material, in which case a uniformly tapered shape is formed over an angle of approximately 60°, looking from the center of the cutout.

The treatment point preferably has a hard metal point or a hard metal plate inserted in it, which is applied to a tooth-like thickening of the material, and an approximately radial tooth edge positioned in the direction of working.

This invention will now be explained in further detail by means of a number of exemplary embodiments.

DESCRIPTION OF PREFERRED EMBODIMENTS

Figure 1:
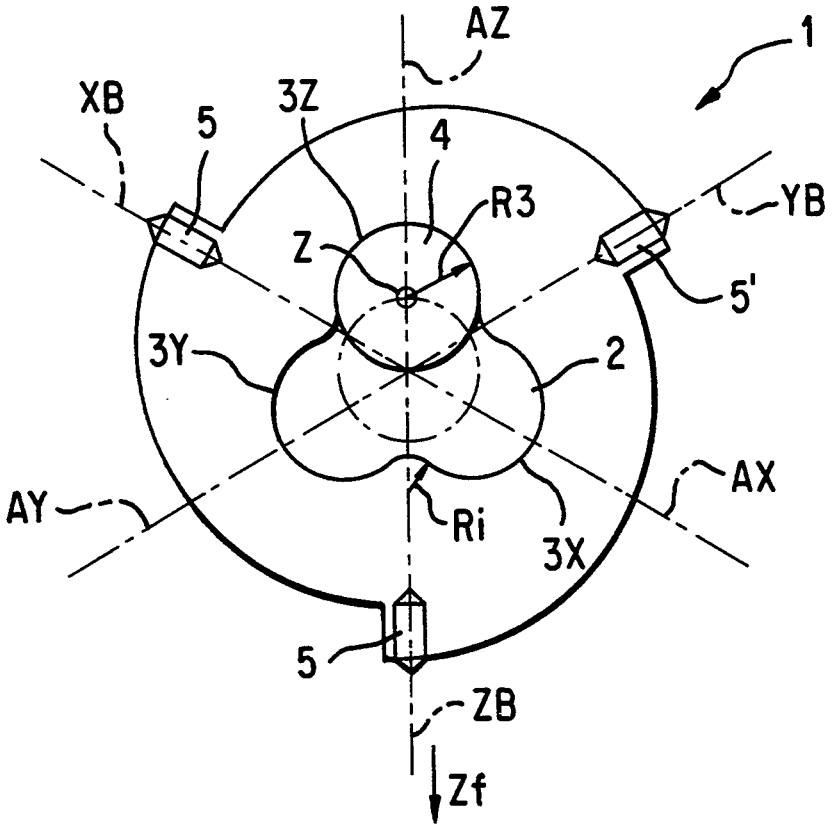
FIG. 1 is a front view of a treatment disk with a striking point, according to one preferred embodiment of this invention.
Figure 2:
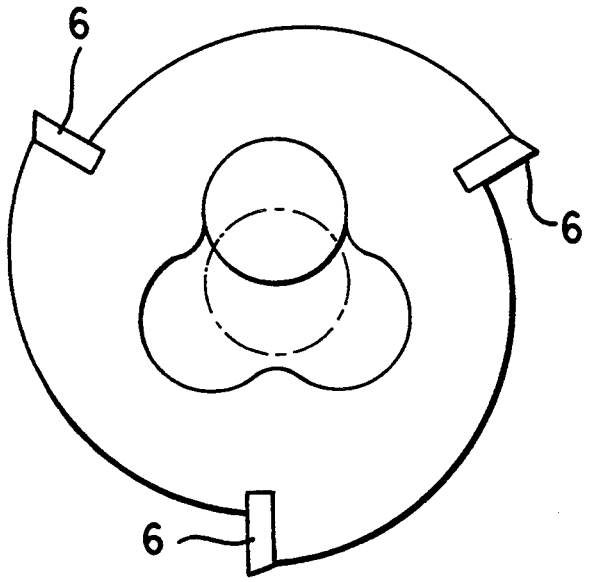
FIG. 2 is a front view of a treatment disk with a striking edge, according to one preferred embodiment of this invention.

Referring to FIGS. 1 and 2, a treatment disk 1 is shown having a three-part shape, the central cutout 2 having an overall shape resembling a three-leaf clover and each of the three "leaves" being a slideway 3. The slideway 3 at least approximately forms a semicircle extending over an angle of approximately 180°, when viewed from its center of rotation. The treatment disk 1 is held by a rotor cage rod 4 and in FIG. 1 moves in a clockwise direction on a rotating rotor cage, not shown in FIG. 1. The centrifugal force Zf mainly operates during free rotation, so that the treatment point ZB takes up the outermost peripheral point for its operating position and is maintained rotationally movable around a center Z of the slideway 3Z.

The slideways 3Z, 3Y, and 3X are connected to each other over a radius Ri, oriented opposite with respect to the three slideways, which is only a fraction with respect to the radius R3 of each slideway 3. The treatment disk 1 has three treatment points ZB, YB, XB which, because of the three-part structure, are offset by 60° from the next respective axis AX or AZ or AY. The diameter of the slideway 3 is larger by a small amount than the diameter of the rotor cage rod 4, which forms a loose sliding seat. In FIG. 1, the treatment points each have a striking point 5 formed by a soldered-in hard metal point. At rest, the treatment disk i in its position shown would slide downward, so that the rotor cage rod 4 would be displaced into the center of rotation Z.

A treatment disk 1 is illustrated in FIG. 2 which, in place of a striking point 5, has three hard metal plates 6, which are well suited for cleaning purposes.

Figure 3:
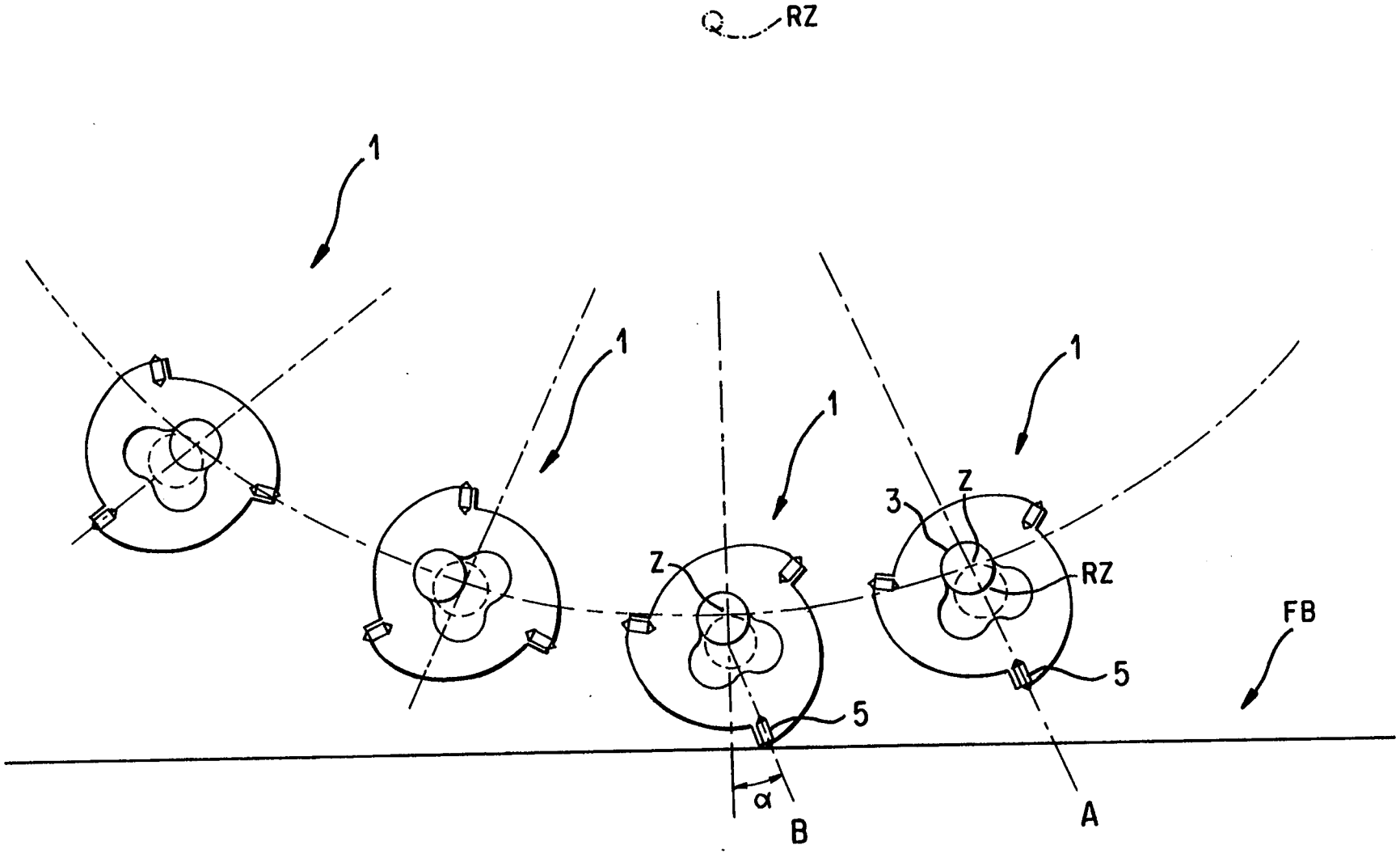
FIG. 3 is a schematic view showing the course of movement over a treatment path.

The movement path of the treatment disk I is shown in FIG. 3, in four positions sequentially over time. In position A, only the centrifugal force acts in addition to weight. The striking point 5 is the outermost circumferential point of the treatment disk 1 and is located on a line of radius which runs through the center of rotation RZ and the center Z of the slideway 3.

At first contact with the floor FB (situation B), the striking point 5 experiences a resistance so that the treatment disk i begins to be deflected around the center Z, as shown by deflection angle $\alpha$. Depending on the size of the received pulse, the treatment disk 1 now rotates one or several times around the center of the slideway 3. However, the distribution of the mass is such that after approximately one revolution the optimum angular position is again reached.

It is possible for the treatment disk 1 to take up any other position within the limits of the cutout 2, for example because of the effect of irregularities and blows thereby generated, or by jerking movements. This does not endanger the treatment quality, but protects the mechanical parts of the machine against excessive wear from shocks.

Figure 4:
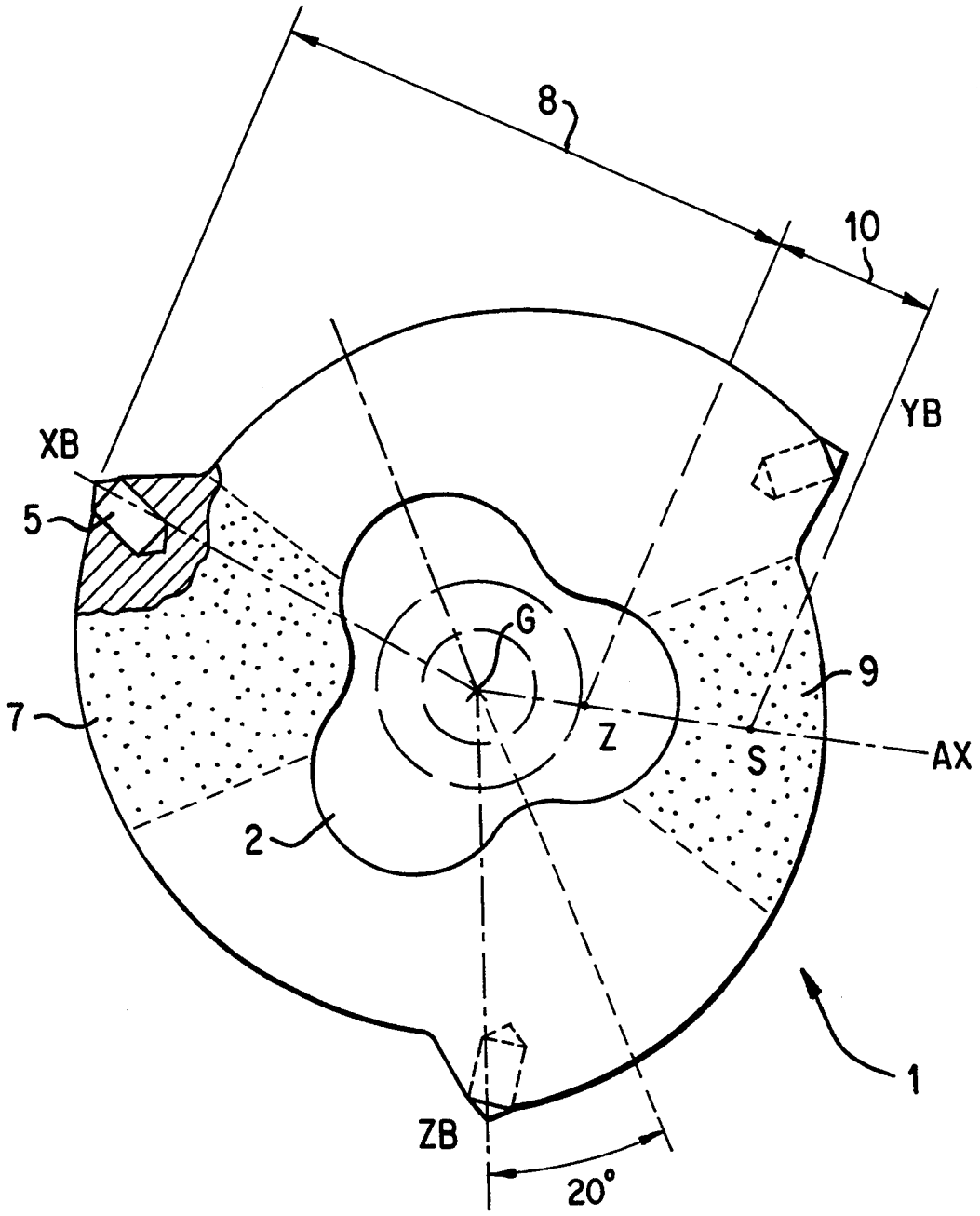
FIG. 4 is another preferred embodiment of the treatment disk of this invention showing preferred proportional dimensions.

The core elements of the treatment disk 1 are shown in FIG. 4 in an enlarged view and in an exaggerated manner. In the left upper half of the illustration, a hammer head 7, positioned by a distance of 8 units in relation to a center of rotation Z, and a small holding mass 9, positioned at a distance of 10 units opposite to the hammer head 7, are clearly shown. The hammer head 7 is located more than twice as far from the center Z as from the center of the holding mass 9.

In relation to treatment disks 1 which are very similar in shape, there is the essential difference that the cutout 2 comprises close, adjacent slideways, each at least approximately semicircular. Thus, chattering of the treatment disks 1 can be avoided which, contrary to opinions up to now, did not result in an improvement of the work efficiency.

The mass in the area of the hammer head 7 is considerably greater than the holding mass 9 in the opposite area, so that the treatment disk 1 always attempts to remain in its respective slideway 3 because of the unevenly distributed centrifugal forces. But, if the rotor cage rod 4 does leave its guide, the disposition of the hammer head 7 offset by approximately 20° makes ganged movement impossible, so that the treatment disk i immediately slides into one of the slideways 3 and the correct, optimal treatment conditions return again.

I claim:

1. In a treatment disk having treatment points distributed about a circumference of the treatment disk and having a central cutout for freely movable seating and stringing together on a rotor cage rod of a device for treating surfaces, the improvement comprising: said cutout having a plurality of at least approximately semicircular slideways, a hammer-like treatment point positioned eccentric relative to a cutout center of said cutout and oppositely positioned with respect to one corresponding said slideway, and a transition from one said slideway to a next said slideway forming a convex circular arc having a radius oriented towards said cutout center of said cutout and increasing a mass of a hammer head area of the treatment disk.

2. In a treatment disk in accordance with claim 1, wherein a first distance between actual centers of rotation of respective said slideways and said cutout center of said cutout is a ratio of at least approximately 1:3 relative to a second distance from said cutout center of said cutout and said treatment point.

3. In a treatment disk in accordance with claim 2, wherein the treatment disk has an odd number of slideways each having a center of rotation and has three said treatment points.

4. In a treatment disk in accordance with claim 3, wherein said treatment points are respectively mounted on a protruding said hammer head which is tooth-shaped.

5. In a treatment disk in accordance with claim 4, wherein said slideways are positioned eccentrically with respect to said cutout center of the treatment disk, said slideways encompass at least a semicircle of approximately 180° and said slideways are transferred in a direction of said cutout center of said cutout at said radius with respect to an adjacent said slideway.

6. In a treatment disk in accordance with claim 5, wherein said slideways have a symmetrical shape with respect to a corresponding axis from said cutout center of said cutout and said center of rotation, wherein a respective said treatment point is positioned on an imaginary axis of symmetry.

7. In a treatment disk in accordance with claim 6, wherein each said hammer head has a striking tool.

8. In a treatment disk in accordance with claim 7, wherein said striking tool is formed by one of an inserted hard metal point and a hard metal plate.

9. In a treatment disk in accordance with claim 8, wherein each said hammer head has a tooth-like shape with a tooth edge positioned in a working direction and extending approximately radially.

10. In a treatment disk in accordance with claim 1, wherein the treatment disk has an odd number of slideways each having a center of rotation and three said treatment points.

11. In a treatment disk in accordance with claim 1, wherein said treatment points are respectively mounted on a protruding said hammer head which is tooth-shaped.

12. In a treatment disk in accordance with claim 1, wherein said slideways are positioned eccentrically with respect to said cutout center of the treatment disk, said slideways encompass at least a semicircle of approximately 180° and said slideways are transferred in a direction of said cutout center of said cutout at a radius with respect to an adjacent said slideway.

13. In a treatment disk in accordance with claim 1, wherein said slideways have a symmetrical shape with respect to a corresponding axis from said cutout center of said cutout and a center of rotation of each said slideway, wherein a respective said treatment point is positioned on an imaginary axis of symmetry.

14. In a treatment disk having treatment points distributed about a circumference of the treatment disk and having a central cutout for freely movable seating and stringing together on a rotor cage rod of a device for treating surfaces, the improvement comprising: said cutout having a plurality of at least approximately semicircular slideways, a hammer-like treatment point positioned eccentric relative to a cutout center of said cutout and oppositely positioned with respect to one corresponding said slideway, and each said treatment point being offset by an angle with respect to an axis passing through said cutout center of said cutout and a slideway center of an oppositely located said slideway.

15. In a treatment disk in accordance with claim 14, wherein each said treatment point is offset with respect to said axis by an angle of less than 30°.

16. In a treatment disk in accordance with claim 14, wherein each said treatment point is offset with respect to said axis by an angle of between 10° and 25°.

17. In a treatment disk having treatment points distributed about a circumference of the treatment disk and having a central cutout for freely movable seating and stringing together on a rotor cage rod of a device for treating surfaces, the improvement comprising: said cutout having a plurality of at least approximately semicircular slideways, a hammer-like treatment point positioned eccentric relative to a cutout center of said cutout and oppositely positioned with respect to one corresponding said slideway, and each of a plurality of hammer heads on which each said treatment point is mounted having a striking tool.

18. In a treatment disk in accordance with claim 17, wherein said striking tool is formed by one of an inserted hard metal point and a hard metal plate.

19. In a treatment disk in accordance with claim 17, wherein each said hammer head has a tooth-like shape with a tooth edge positioned in a working direction and extending approximately radially.

* * * * *